US008794984B2

(12) United States Patent
Chen et al.

(10) Patent No.: US 8,794,984 B2
(45) Date of Patent: Aug. 5, 2014

(54) PROTECTIVE STRUCTURE FOR COVERING A CONNECTOR AND ELECTRONIC DEVICE THEREWITH

(71) Applicant: Wistron Corporation, New Taipei (TW)

(72) Inventors: Dong-Ying Chen, New Taipei (TW); Zhong-hui Mao, New Taipei (TW)

(73) Assignee: Wistron Corporation, Hsichih, New Taipei (TW)

( * ) Notice: Subject to any disclaimer, the term of this patent is extended or adjusted under 35 U.S.C. 154(b) by 52 days.

(21) Appl. No.: 13/686,874

(22) Filed: Nov. 27, 2012

(65) Prior Publication Data

US 2014/0038441 A1 Feb. 6, 2014

(30) Foreign Application Priority Data

Aug. 1, 2012 (CN) ..... 2012 1 0272629

(51) Int. Cl.
*H01R 13/52* (2006.01)

(52) U.S. Cl.
CPC ..... *H01R 13/5213* (2013.01); *H01R 2201/06* (2013.01)
USPC ..... 439/136

(58) Field of Classification Search
USPC ..... 439/136, 135, 145, 372; 174/50, 66, 6
See application file for complete search history.

(56) References Cited

U.S. PATENT DOCUMENTS

| | | | | |
|---|---|---|---|---|
| 5,800,028 | A * | 9/1998 | Smith et al. | 312/223.1 |
| 6,984,139 | B1 * | 1/2006 | Lai | 439/142 |
| 7,331,804 | B2 * | 2/2008 | Okada et al. | 439/139 |
| 7,806,707 | B1 * | 10/2010 | Lai | 439/145 |
| 7,896,667 | B2 * | 3/2011 | Qing | 439/142 |
| 7,922,531 | B2 * | 4/2011 | Takahashi | 439/607.01 |
| 8,029,299 | B1 * | 10/2011 | Huang | 439/135 |
| 8,153,895 | B2 * | 4/2012 | Drane | 174/66 |
| 8,496,488 | B2 * | 7/2013 | Grimm et al. | 439/144 |
| 2006/0046542 | A1 * | 3/2006 | Obara et al. | 439/135 |
| 2007/0004255 | A1 * | 1/2007 | Kuo | 439/136 |

* cited by examiner

*Primary Examiner* — Alexander Gilman
(74) *Attorney, Agent, or Firm* — Winston Hsu; Scott Margo

(57) ABSTRACT

A protective structure includes a covering body, a protective component, a fixing component and a fastening portion. The covering body is for covering the connector. The protective component is connected to the covering body and for plugging into the connector. The fixing component is connected to a side of the covering body and for plugging into an installation hole on a case of the electronic device. The fixing component includes a shaft for pivoting relative to the case so as to drive the covering body to a position where the covering body does not cover the connector when the protective component does not plug into the connector. The fastening portion is installed on the fixing component and is for contacting against the installation hole after the fixing component is plugged into the installation hole so as to prevent the fixing component from separating from the installation hole.

18 Claims, 9 Drawing Sheets

PROTECTIVE STRUCTURE FOR COVERING A CONNECTOR AND ELECTRONIC DEVICE THEREWITH

BACKGROUND OF THE INVENTION

1. Field of the Invention

The present invention relates to a protective structure and an electronic device with the protective structure, and more specifically, to a protective structure for covering a connector of an electronic device and the electronic device with the protective structure.

2. Description of the Prior Art

A conventional electronic device, such as a notebook computer or a personal desktop computer, often has numerous connectors for connecting with various external devices, such as a mouse, an external hard drive, a display device, and so on. There are many kinds of connectors, which are well developed and widely used for the conventional electronic device, such as an USB (Universal Serial Bus) connector, a HDMI (High-Definition Multimedia Interface) connector, an IEEE 1394 connector, a LAN (Local Area Network) connector and an ESATA (external SATA) connector. However, the conventional connectors are exposed on a casing of the electronic device. If the connectors are not in use for a long time, the moisture might get into the connectors, so that pins and metal pads of the connectors are oxidative and rusty. As a result, it decreases transmission efficiency and quality of the connectors, and even causes damage to the connectors. Therefore, it is an important issue to design a protective structure to prevent the connector from getting rusty and to prevent a foreign body from entering into the connector.

SUMMARY OF THE INVENTION

The present invention is to provide a protective structure for covering a connector and an electronic device with the protective structure to solve above problems.

In order to achieve above purposes, the protective structure includes a covering body, a protective component, a fixing component and a fasten portion. The covering body is for covering the connector. The protective component is connected to the covering body and is for plugging into the connector. The fixing component is connected to a side of the covering body and for plugging into an installation hole on a case of the electronic device, and the fixing component includes a shaft for pivoting relative to the case so as to drive the covering body to a position where the covering body does not cover the connector when the protective component does not plug into the connector. The fasten portion is installed on the fixing component and is for contacting against the installation hole after the fixing component is plugged into the installation hole, so as to prevent the fixing component from separating from the installation hole.

According to the disclosure, the fixing component further includes a guiding portion, and a hole is formed on the guiding portion whereinto a guiding component is inserted, so as to guide the guiding portion to plug into the installation hole.

According to the disclosure, the fastening portion is disposed between the shaft and the guiding portion.

According to the disclosure, a maximum outer diameter of the fastening portion is greater than a diameter of the installation hole, and the fastening portion is made of resilient material.

According to the disclosure, a slot is formed on the fastening portion for being pushed inward by the installation hole as the fastening portion is passing through the installation hole, so that the fastening portion can pass through the installation hole.

According to the disclosure, the protective component includes an upper protective portion and a lower protective portion for clipping a tongue piece of the connector cooperatively as the protective component is plugged into the connector of the electronic device.

According to the disclosure, a groove is formed on the upper protective portion or the lower protective portion, so as to reduce structural rigidity of the protective component.

According to the disclosure, a step is formed between the covering body and the protective component, so as to prevent the covering body from falling into the connector.

According to the disclosure, an inclined structure is formed on the fastening portion, so as to guide the fastening portion to move into the installation hole.

According to the disclosure, a diameter of the installation hole is greater than an outer diameter of the shaft.

According to the disclosure, an electronic device includes a case, a connector, and a protective structure. An installation hole is formed on the case. The connector is disposed inside the case. The protective structure includes a covering body, a protective component, a fixing component and a fasten portion. The covering body is for covering the connector. The protective component is connected to the covering body and is for plugging into the connector. The fixing component is connected to a side of the covering body and is for plugging into the installation hole on the case of the electronic device, and the fixing component includes a shaft for pivoting relative to the case so as to drive the covering body to a position where the covering body does not cover the connector when the protective component does not plug into the connector. The fasten portion is installed on the fixing component and is for contacting against the installation hole after the fixing component is plugged into the installation hole, so as to prevent the fixing component from separating from the installation hole.

The protective structure of the present invention utilizes the protective component to plug into the connector to clip the tongue piece of the connector, so as to solve the problem that the metal pads and the pins of the tongue piece absorb the moisture in the air and become oxidative and rusty as the connector is not used for a long time. In addition, the covering body can cover the connector to isolate the environmental air and to prevent the foreign body from entering into the connector, so that the covering body can protect the connector. Moreover, the fastening portion of the protective structure is designed to prevent the fixing component from separating from the installation hole after the fixing component is plugged into the installation hole of the electronic device, so as to prevent the protective structure from loss when the protective structure is not in use. Furthermore, because the shaft is pivotally installed on the installation hole, if users desire to plug the external device into the connector, users can directly pivot the covering body relative to the case to the position where the covering body does not cover the connector without detaching the protective structure from the case, so as to prevent the protective structure from loss and to increase convenience of assembly.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
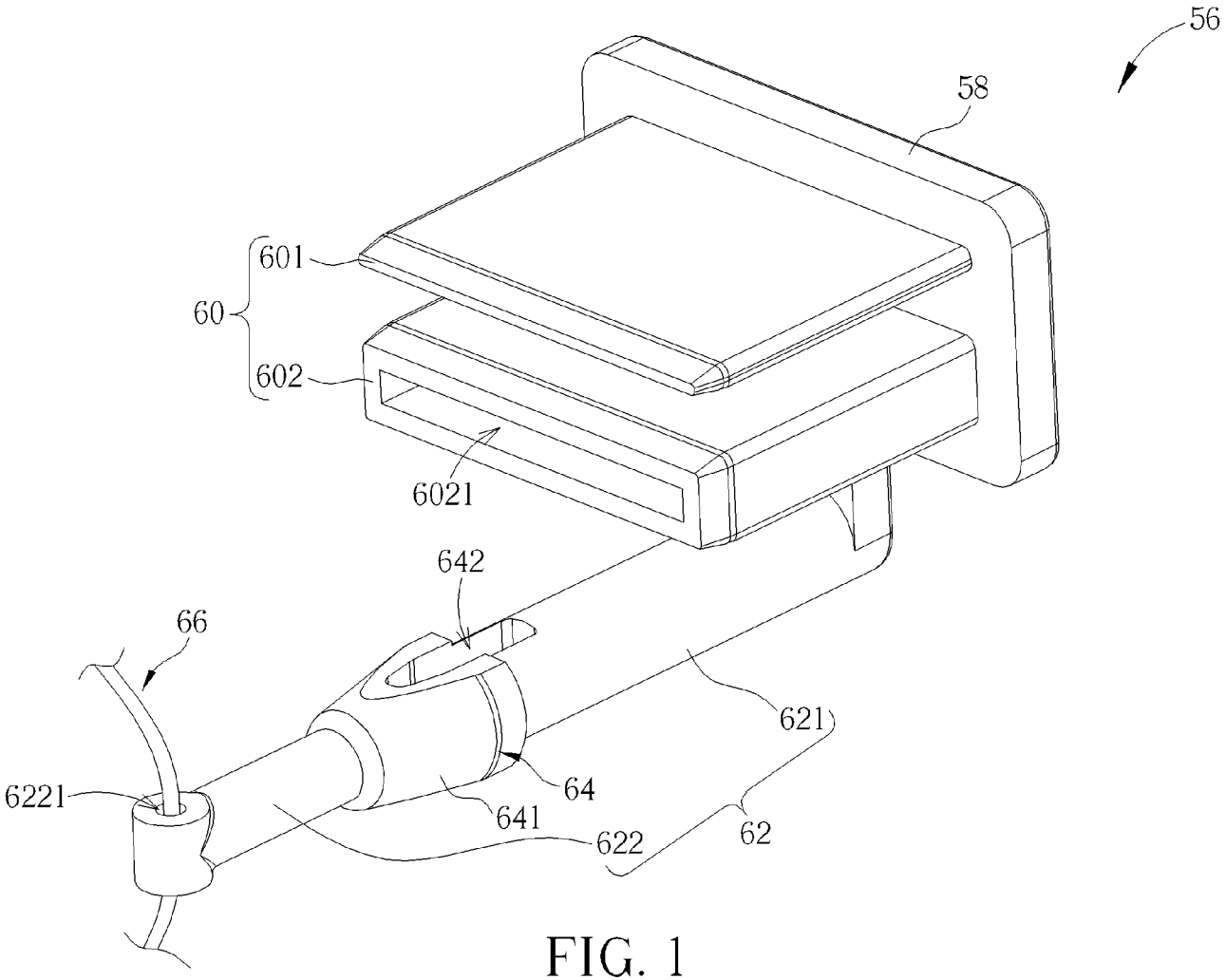
FIG. 1 is a diagram of a protective structure according to an embodiment of the invention.
Figure 2:
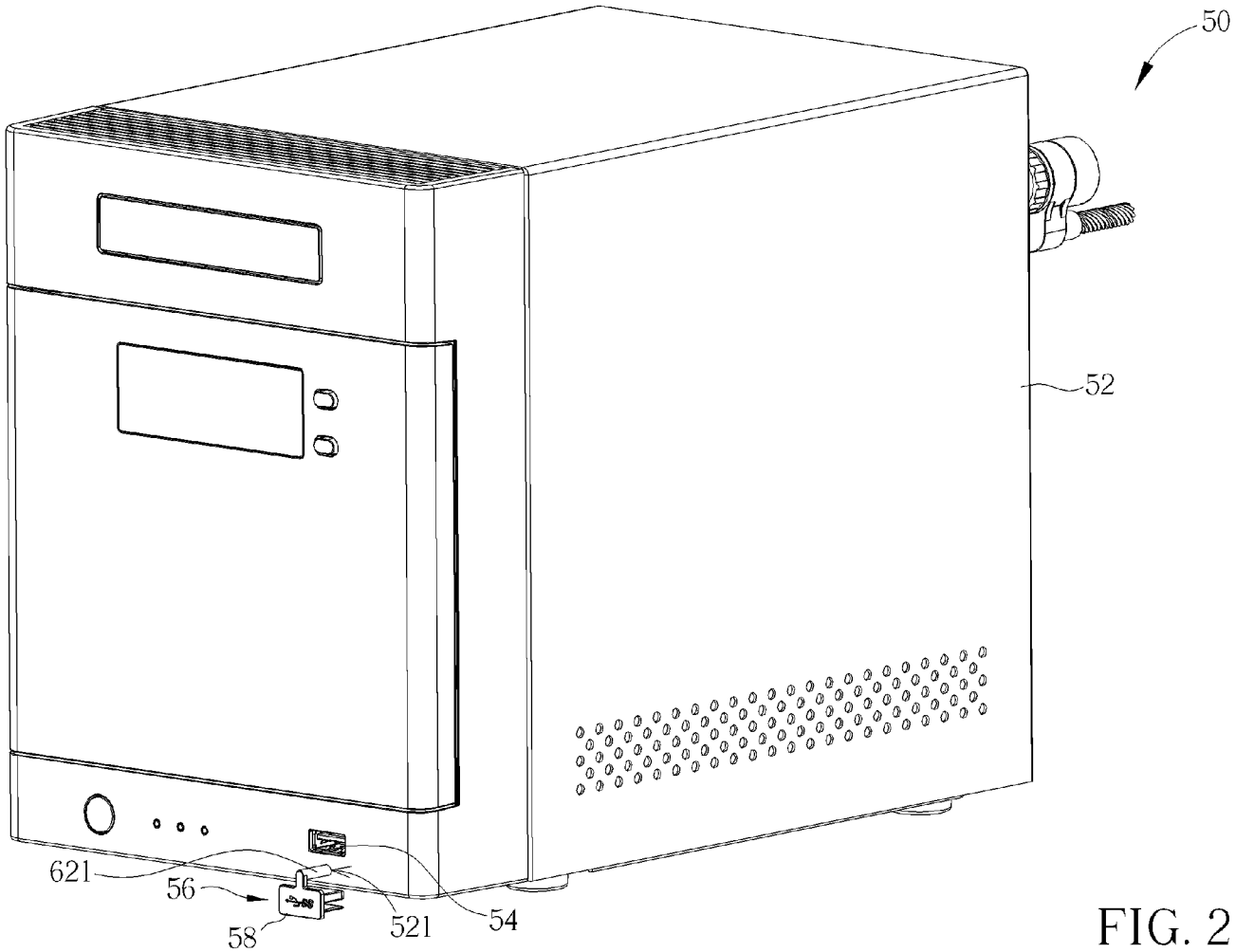
FIG. 2 is a diagram of an electronic device according to the embodiment of the invention.
Figure 3:
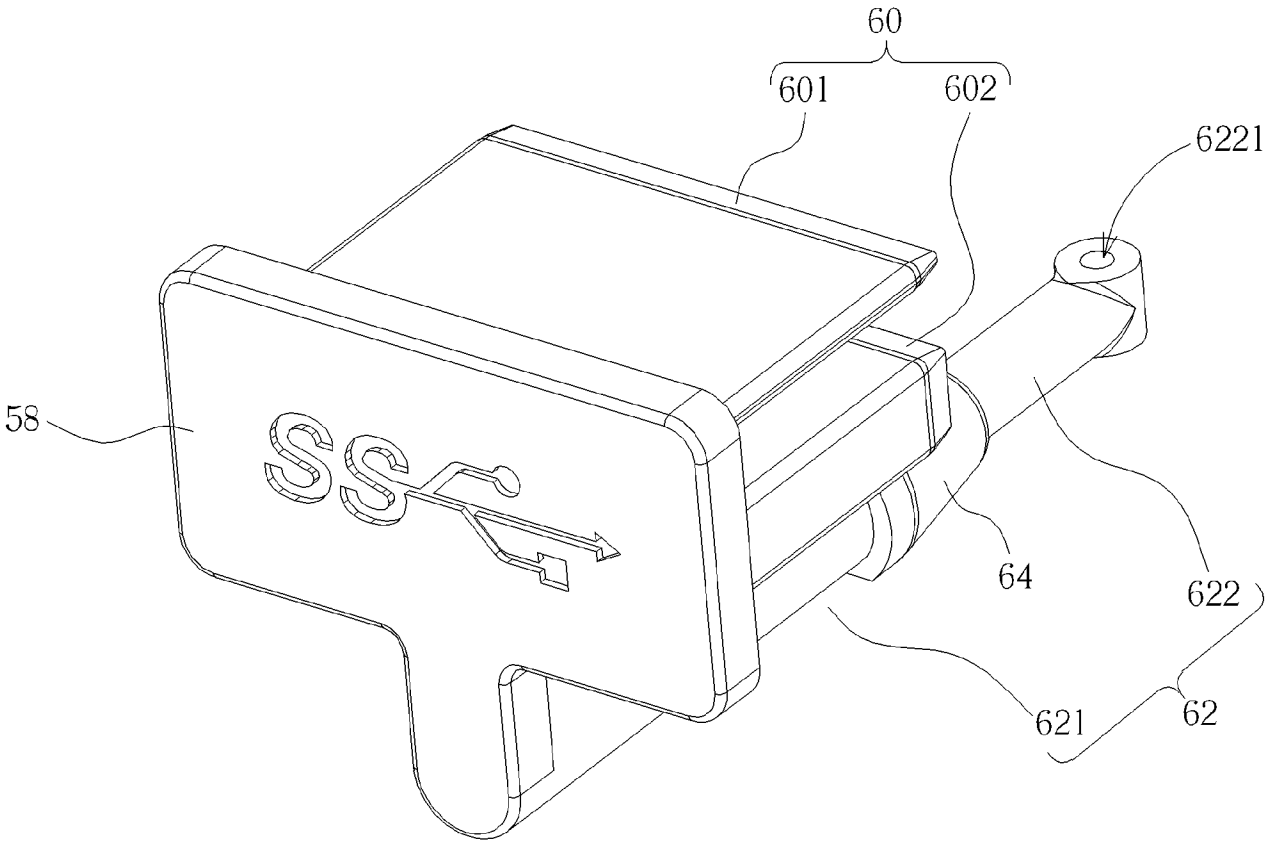
FIG. 3 shows another view of the protective structure according to the embodiment of the invention.

Please refer to FIG. 1 to FIG. 3. FIG. 1 is a diagram of a protective structure 56 according to an embodiment of the invention. FIG. 2 is a diagram of an electronic device 50 according to the embodiment of the invention. FIG. 3 shows another view of the protective structure 56 according to the embodiment of the invention. The electronic device 50 can be a desktop computer, a business server, and so on. The electronic device 50 includes a case 52, a connector 54, and a protective structure 56. The case 52 is for protecting internal electronic components of the electronic device 50, such as a CPU, a RAM, a hard drive and so on. An installation hole 521 is formed on the case 52. The connector 54 is disposed inside the case 52. The connector 54 can conform to any kind of specification, such as an USB (Universal Serial Bus) connector, a HDMI (High-Definition Multimedia Interface) connector, a LAN (Local Area Network) connector, and so on. In this embodiment, the connector 54 can be an USB connector. The protective structure 56 is for protecting the connector 54. The protective structure 56 includes a covering body 58, a protective component 60, a fixing component 62 and a fastening portion 64. The protective component 60 is connected to the covering body 58 and is for plugging into the connector 54, so as to prevent the connector 54 from absorbing the moisture and being oxidative and rusty. And the covering body 58 can prevent a foreign body from entering into the connector 54. In addition, the protective component 60 includes an upper protective portion 601 and a lower protective portion 602. A groove can be formed on the upper protective portion 601 or the lower protective portion 602, so as to reduce structural rigidity of the protective component 60. In this embodiment, as shown in FIG. 1, a groove 6021 is formed on the lower protective portion 602.

The fixing component 62 is connected to a side of the covering body 58 and is for plugging into the installation hole 521 on the case 52 of the electronic device 50. The fixing component 62 includes a shaft 621 for pivoting relative to the case 52, so as to drive the covering body 58 to a position where the covering body 58 does not cover the connector 54 as shown in FIG. 2, when the protective component 60 does not plug into the connector 54. That is, the covering body 58 can rotate to a lower position, so as to expose an opening of the connector 54, and users can connect an external device with the connector 54. In addition, the fixing component 62 further includes a guiding portion 622, and a hole 6221 is formed on the guiding portion 622 whereinto a guiding component 66 is inserted, so as to guide the guiding portion 622 to plug into the installation hole 521. The fastening portion 64 is installed on the fixing component 62. The fastening portion 64 is made of resilient material and is disposed between the shaft 621 and the guiding portion 622. The fastening portion 64 is for contacting against the installation hole 521 after the fixing component 62 is plugged into the installation hole 521, so as to prevent the fixing component 62 from separating from the installation hole 521. An inclined structure 641 is formed on the fastening portion 64, so as to guide the fastening portion 64 to move into the installation hole 521. In addition, a slot 642 is formed on the fastening portion 64 for being pushed inward by the installation hole 521 as the fastening portion 64 is passing through the installation hole 521, so that the fastening portion 64 can deform and then pass through the installation hole 521 smoothly.

Figure 4:
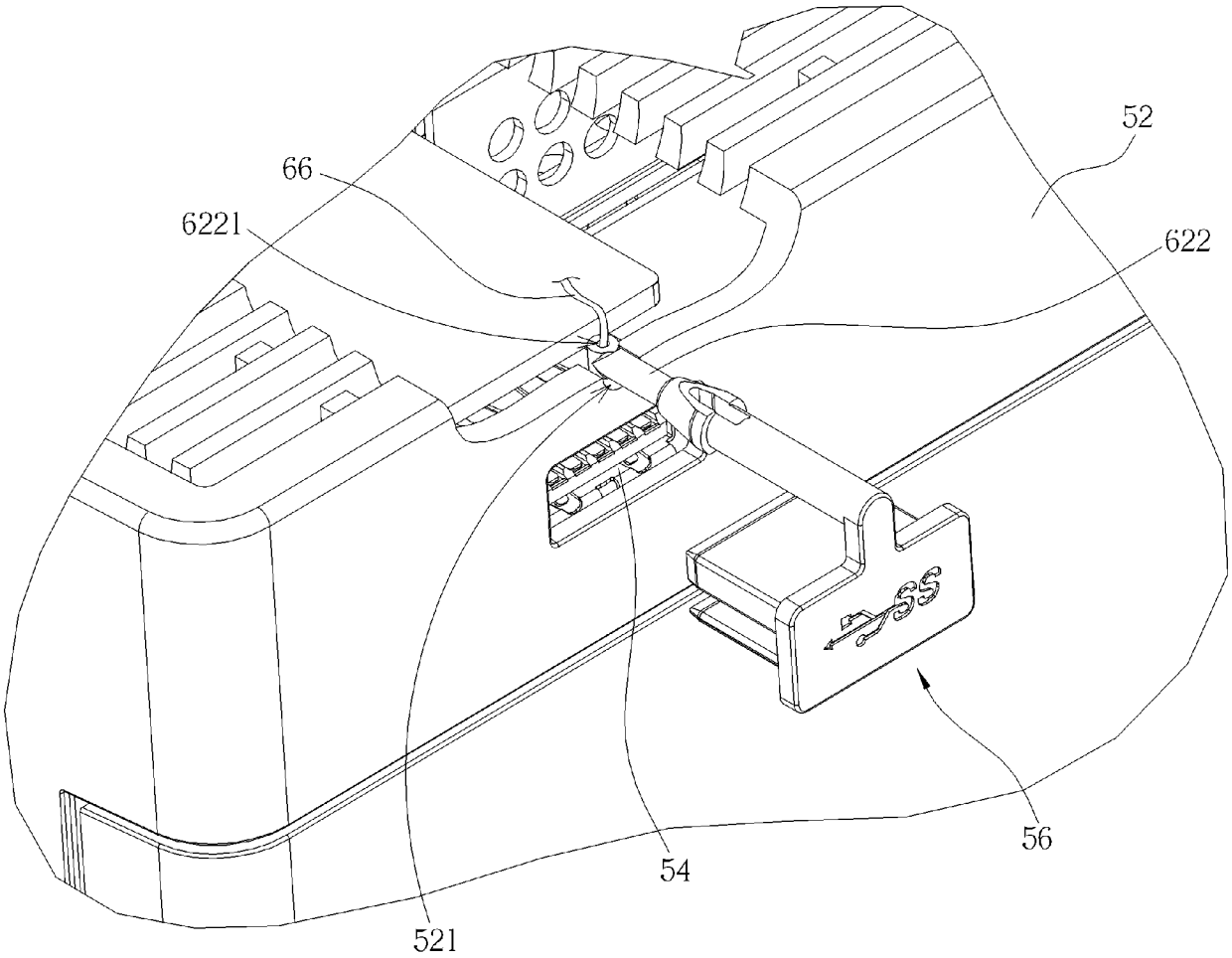
FIG. 4 to FIG. 6 are partial structural diagrams of the protective structure plugging into an installation hole according to the embodiment of the invention.
Figure 5:
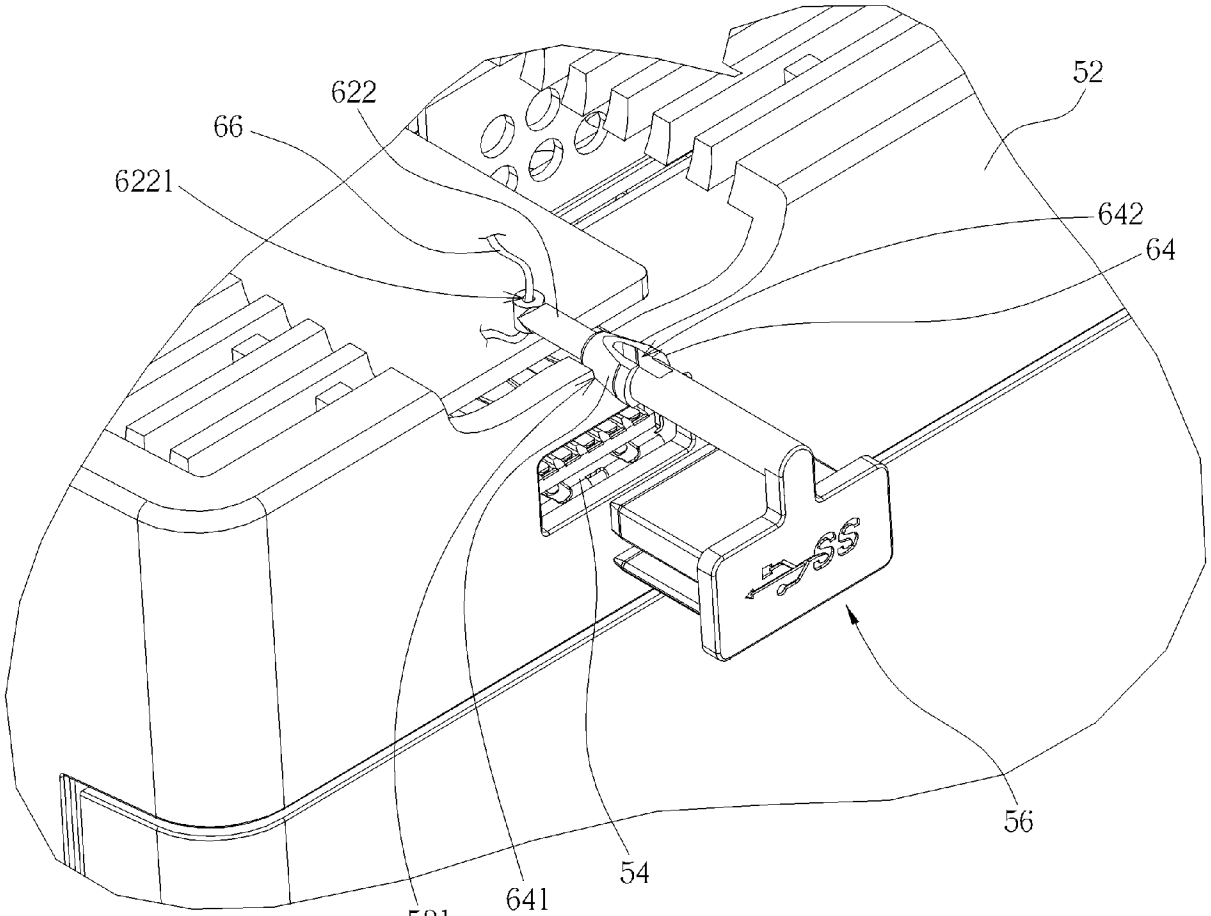
Figure 6:
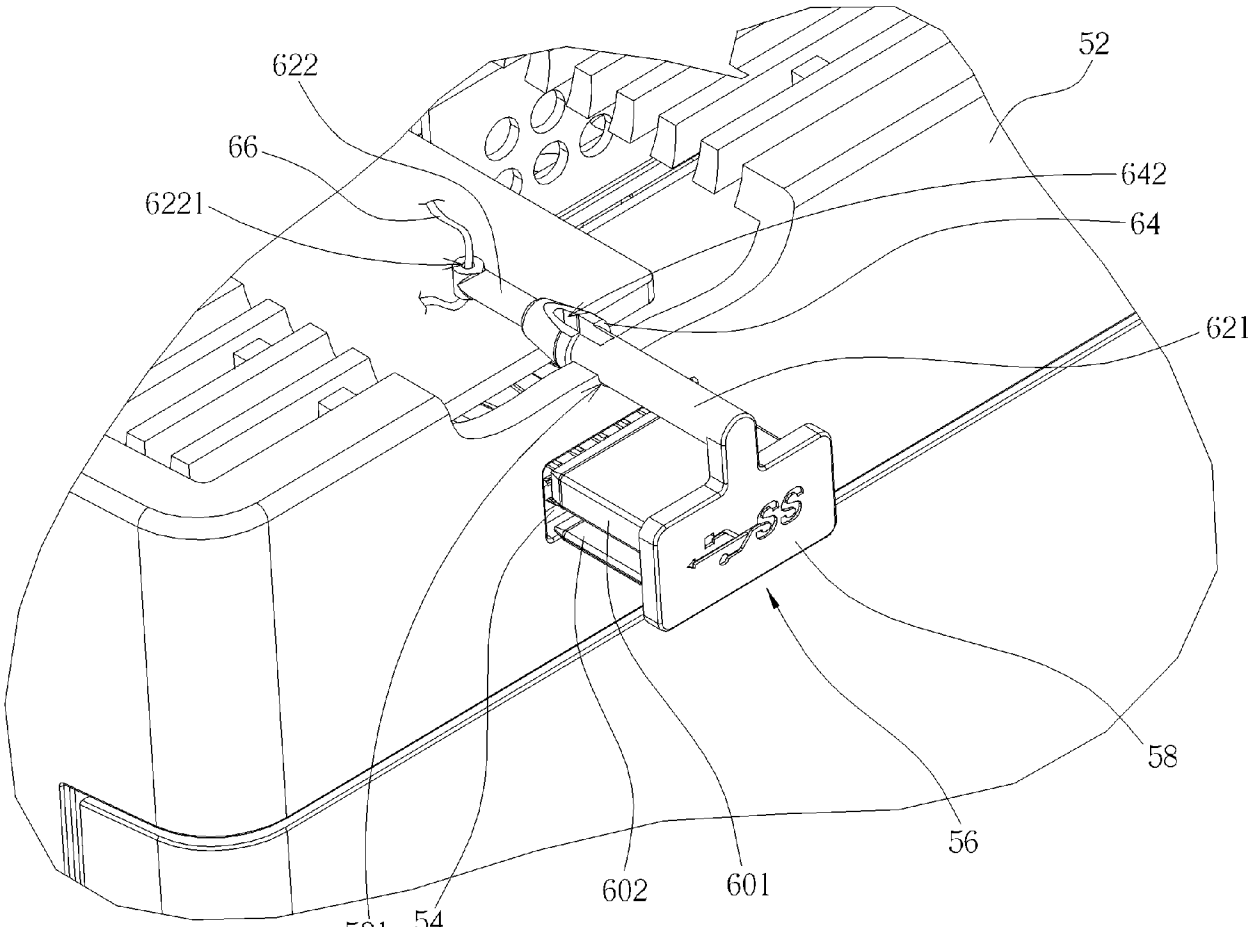
Figure 7:
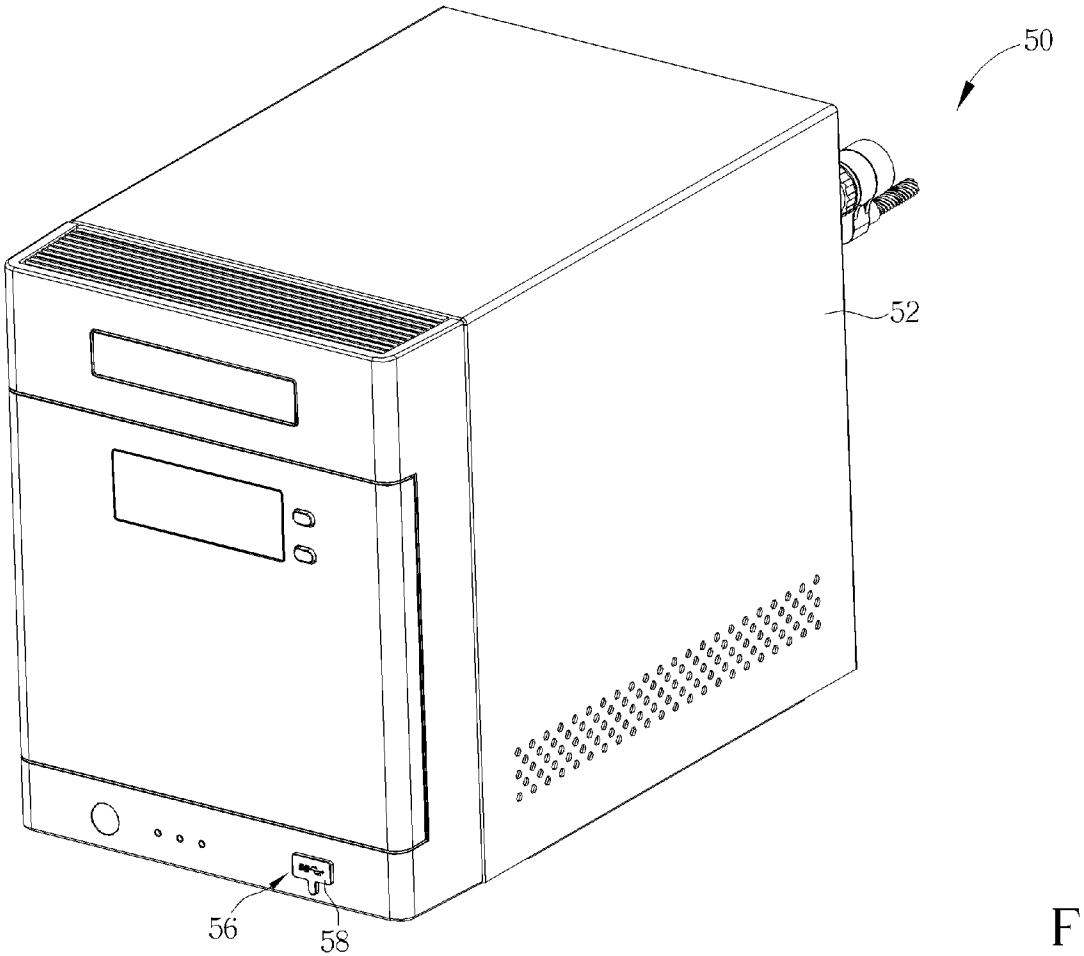
FIG. 7 is a diagram of the electronic device after the protective structure plugs into the installation hole according to the embodiment of the invention.
Figure 8:
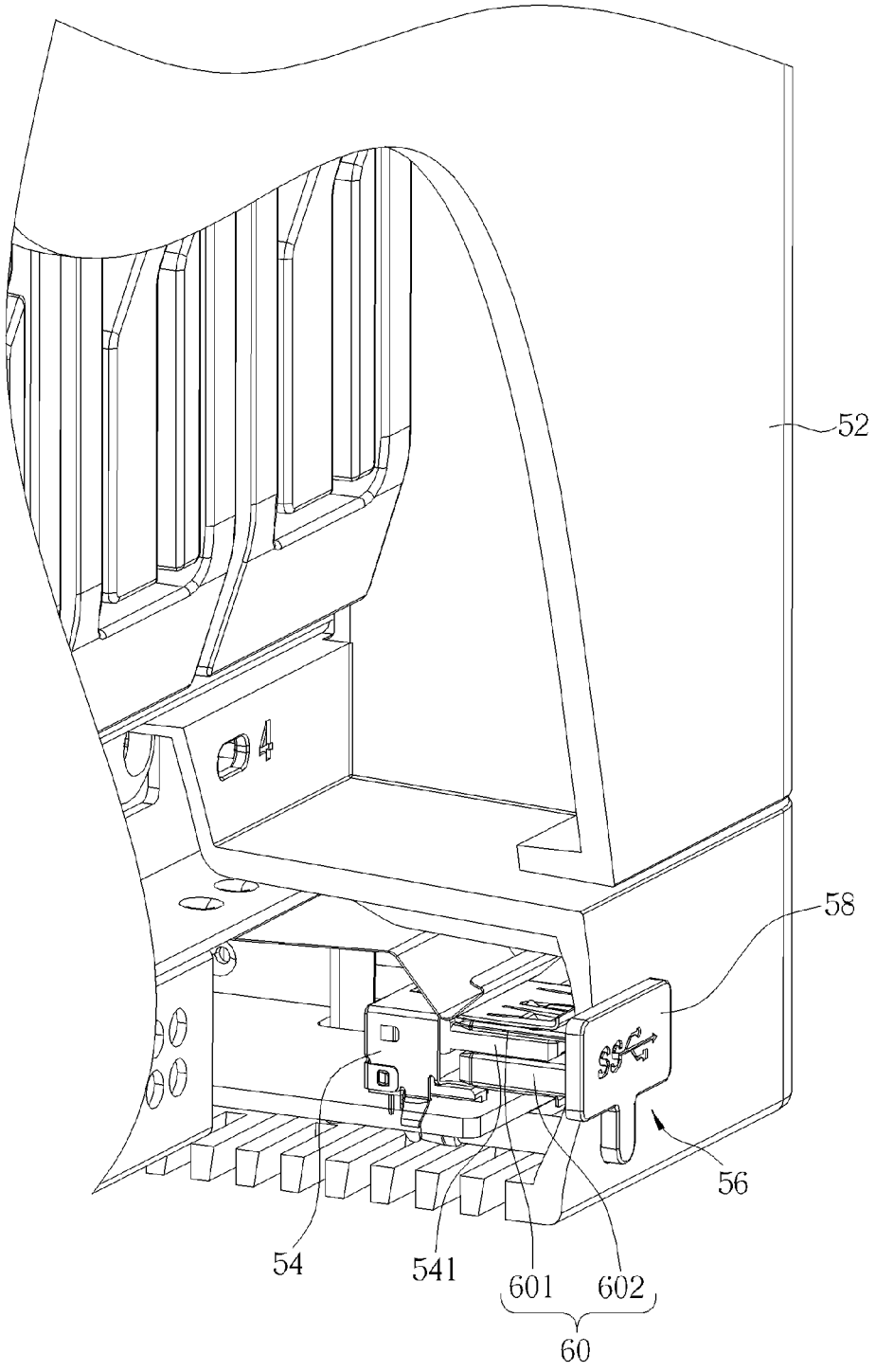
FIG. 8 is a partial internal structural diagram of the electronic device according to the embodiment of the invention.

Next, a procedure of plugging the protective structure 56 into the installation hole 521 is described as follows. Please refer to FIG. 4 to FIG. 8. FIG. 4 to FIG. 6 are partial structural diagrams of the protective structure 56 plugging into the installation hole 521 according to the embodiment of the invention. FIG. 7 is a diagram of the electronic device 50 after the protective structure 56 plugs into the installation hole 521 according to the embodiment of the invention. FIG. 8 is a partial internal structural diagram of the electronic device 50 according to the embodiment of the invention. As shown in FIG. 4, the guiding portion 622 of the protective structure 56 can be plugged into the installation hole 521 first. A maximum outer diameter of the guiding portion 622 can be designed to be less than a diameter of the installation hole 521, so that the guiding portion 622 can pass through the installation hole 521. After that, operators can pull the guiding portion 622 to move into the installation hole 521 by the guiding component 66 as the guiding component 66 has passed through the hole 6221. As shown in FIG. 5, as the guiding portion 622 keeps moving inward, the fastening portion 64 will reach the installation hole 521. At this time, the inclined structure 641 contacts the installation hole 521 first. The inclined structure 641 is for guiding the fastening portion 64 to move into the installation hole 521. A maximum outer diameter of the fastening portion 64 is greater than the diameter of the installation hole 521, and the fastening portion 64 is made of resilient material, so that the fastening portion 64 is forced and pushed by the installation hole 521, and the slot 642 is deformed inward as the fastening portion 64 is moving into the installation hole 521. As a result, the fastening portion 64 is deformed and can pass through the installation hole 521. Please refer to FIG. 6, the fastening portion 64 passes through the installation hole 521 and moves to an inside of the case 52, and the shaft 621 is plugged into the case 52. Because the diameter of the installation hole 521 is greater than an outer diameter of the shaft 621, the shaft 621 is not pushed by the installation hole 521 and can pass through the installation hole 521 successfully.

As shown in FIG. 7 and FIG. 8, the protective structure 56 is plugged into the installation hole 521 and the connector 54 finally. As shown in FIG. 8, as the protective component 60 of the protective structure 56 is plugged into the connector 54 completely, the upper protective portion 601 and the lower protective portion 602 of the protective component 60 cooperatively clip a tongue piece 541 of the connector 54, for prevent metal pads of the tongue piece 541 from contacting the moisture and being oxidative and rusty, resulting in decreasing transmission efficiency and quality of the connector 54. Moreover, as shown in FIG. 1, it is noticed that a step is formed between the covering body 58 of the protective structure 56 and the protective component 60. It is designed to prevent the covering body 58 from falling into the connector 54 deeply as the protective structure 56 is plugged into the connector 54. As shown in FIG. 7 and FIG. 8, the covering body 58 is located outside the connector 54 and does not fall into an inner space of the connector 54 as the protective structure 56 is plugged into the connector 54. Besides, a related identification pattern can be printed on the covering body 58. Therefore, users still can identify the specification of the connector 54 as the covering body 58 covers the connector 54.

Figure 9:
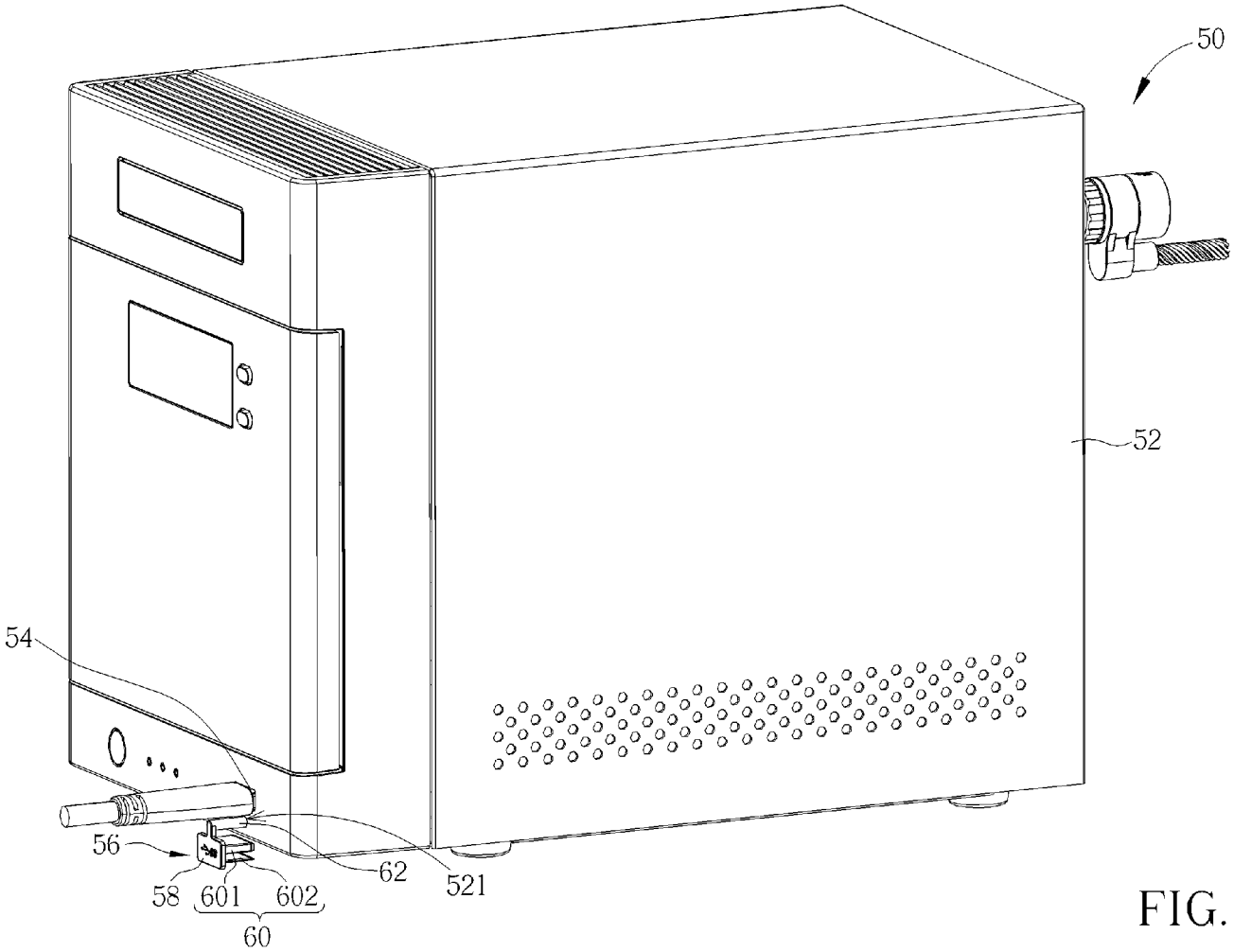
FIG. 9 is a diagram of the electronic device connected with an external device plugging into the installation hole according to the embodiment of the invention.

As the protective structure 56 is plugged into the connector 54 and users desire to connect the external device with the connector 54, users only need to pull the covering body 58 away from the connector 54, so that the protective component 60 is separated from the connector 54. Because the fastening portion 64 contacts against the installation hole 521 inside the case 52, the fixing component 62 is not separated from the installation hole 521. And then the covering body 58 can be pivoted relative to the case 52 to the position where the covering body 58 does not cover the connector 54. Please refer to FIG. 9. FIG. 9 is a diagram of the electronic device connected with an external device plugging into the installation hole according to the embodiment of the invention. At this time, the protective structure 56 does not cover the connector 54, so users can plug the external device into the connector 54.

In contrast to the prior art, the protective structure of the present invention utilizes the protective component to plug into the connector to clip the tongue piece of the connector, so as to solve the problem that the metal pads and the pins of the tongue piece absorb the moisture in the air and become oxidative and rusty as the connector is not used for a long time. In addition, the covering body can cover the connector to isolate the environmental air and to prevent the foreign body from entering into the connector, so that the covering body can protect the connector. Moreover, the fastening portion of the protective structure is designed to prevent the fixing component from separating from the installation hole after the fixing component is plugged into the installation hole of the electronic device, so as to prevent the protective structure from loss when the protective structure is not in use. Furthermore, because the shaft is pivotally installed on the installation hole, if users desire to plug the external device into the connector, users can directly pivot the covering body relative to the case to the position where the covering body does not cover the connector without detaching the protective structure from the case, so as to prevent the protective structure from loss and to increase convenience of assembly.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A protective structure for covering a connector of an electronic device, comprising:

a covering body for covering the connector;

a protective component connected to the covering body and for plugging into the connector;

a fixing component connected to a side of the covering body and for plugging into an installation hole on a case of the electronic device, the fixing component comprising a shaft for pivoting relative to the case so as to drive the covering body to a position where the covering body does not cover the connector when the protective component does not plug into the connector, the fixing component further comprising a guiding portion, and a hole being formed on the guiding portion whereinto a guiding component is inserted, so as to guide the guiding portion to plug into the installation hole; and a fasten portion installed on the fixing component and for contacting against the installation hole after the fixing component is plugged into the installation hole, so as to prevent the fixing component from separating from the installation hole.

2. The protective structure of claim 1, wherein the fastening portion is disposed between the shaft and the guiding portion.

3. The protective structure of claim 1, wherein a maximum outer diameter of the fastening portion is greater than a diameter of the installation hole, and the fastening portion is made of resilient material.

4. The protective structure of claim 3, wherein a slot is formed on the fastening portion for being pushed inward by the installation hole as the fastening portion is passing through the installation hole, so that the fastening portion can pass through the installation hole.

5. The protective structure of claim 1, wherein the protective component comprises an upper protective portion and a lower protective portion for clipping a tongue piece of the connector cooperatively as the protective component is plugged into the connector of the electronic device.

6. The protective structure of claim 5, wherein a groove is formed on the upper protective portion or the lower protective portion, so as to reduce structural rigidity of the protective component.

7. The protective structure of claim 1, wherein a step is formed between the covering body and the protective component, so as to prevent the covering body from falling into the connector.

8. The protective structure of claim 1, wherein an inclined structure is formed on the fastening portion, so as to guide the fastening portion to move into the installation hole.

9. The protective structure of claim 1, wherein a diameter of the installation hole is greater than an outer diameter of the shaft.

10. An electronic device, comprising:

a case where on an installation hole formed;

a connector disposed inside the case; and a protective structure, comprising:

a covering body for covering the connector;

a protective component connected to the covering body and for plugging into the connector;

a fixing component connected to a side of the covering body and for plugging into the installation hole on the case of the electronic device, the fixing component comprising a shaft for pivoting relative to the case so as to drive the covering body to a position where the covering body does not cover the connector when the protective component does not plug into the connector, the fixing component further comprising a guiding portion, and a hole being formed on the guiding portion whereinto a guiding component is inserted, so as to guide the guiding portion to plug into the installation hole; and a fasten portion installed on the fixing component and for contacting against the installation hole after the fixing component is plugged into the installation hole, so as to prevent the fixing component from separating from the installation hole.

11. The electronic device of claim 10, wherein the fastening portion is disposed between the shaft and the guiding portion.

12. The electronic device of claim 10, wherein a maximum outer diameter of the fastening portion is greater than a diameter of the installation hole, and the fastening portion is made of resilient material.

13. The electronic device of claim 12, wherein a slot is formed on the fastening portion for being pushed inward by the installation hole as the fastening portion is passing through the installation hole, so that the fastening portion can pass through the installation hole.

14. The electronic device of claim 10, wherein the protective component comprises an upper protective portion and a lower protective portion for clipping a tongue piece of the connector cooperatively as the protective component is plugged into the connector of the electronic device.

15. The electronic device of claim 14, wherein a groove is formed on the upper protective portion or the lower protective portion, so as to reduce structural rigidity of the protective component.

16. The electronic device of claim 10, wherein a step is formed between the covering body and the protective component, so as to prevent the covering body from falling into the connector.

17. The electronic device of claim 10, wherein an inclined structure is formed on the fastening portion, so as to guide the fastening portion to move into the installation hole.

18. The electronic device of claim 10, wherein a diameter of the installation hole is greater than an outer diameter of the shaft.

* * * * *